US011577910B2

(12) United States Patent
Ayers et al.

(10) Patent No.: US 11,577,910 B2
(45) Date of Patent: Feb. 14, 2023

(54) SYSTEM AND METHOD FOR A CONTAINER SUPPORT

(71) Applicant: THE BOEING COMPANY, Chicago, IL (US)

(72) Inventors: Aaron Robert Ayers, Granite Falls, WA (US); Justin Joseph Ulle, Monroe, WA (US)

(73) Assignee: The Boeing Company, Chicago, IL (US)

( * ) Notice: Subject to any disclaimer, the term of this patent is extended or adjusted under 35 U.S.C. 154(b) by 54 days.

(21) Appl. No.: 16/719,500

(22) Filed: Dec. 18, 2019

(65) Prior Publication Data

US 2021/0188542 A1 Jun. 24, 2021

(51) Int. Cl.
*B65F 1/16* (2006.01)
*B65F 1/14* (2006.01)

(52) U.S. Cl.
CPC ..... *B65F 1/1623* (2013.01); *B65F 1/1415* (2013.01); *B65F 1/1615* (2013.01); *B65F 2001/1676* (2013.01)

(58) Field of Classification Search
CPC .... B65F 1/1623; B65F 1/1615; B65F 1/1415; B65F 2001/1676
USPC ..... 248/99, 95
See application file for complete search history.

(56) References Cited

U.S. PATENT DOCUMENTS 3,260,488 A * 7/1966 Kliewer ..... B65B 67/1244 383/68
3,653,619 A * 4/1972 Plum ..... B65B 67/1205 312/275
3,749,301 A 7/1973 Peckar
4,069,994 A * 1/1978 Wharmby ..... B65B 67/125 248/101
5,704,480 A * 1/1998 Scholz ..... A61F 13/041 383/68
9,643,756 B2 * 5/2017 Tanaike ..... B65D 33/20
2003/0190097 A1 * 10/2003 Hajianpour ..... B65D 33/14 383/34.1

(Continued)

OTHER PUBLICATIONS

WaterSeals Waterproof Magnetic Mini Tablet Pouch, https://lewisnclark.com/waterseals-waterproof-magnetic-mini-tablet-pouch/, dated accessed Dec. 18, 2019.

(Continued)

*Primary Examiner* — Muhammad Ijaz
(74) *Attorney, Agent, or Firm* — Armstrong Teasdale LLP

(57) ABSTRACT

A container support for holding and closing a container includes a base assembly, a connector, a handle assembly, and a plurality of arms. The base assembly has a first side and a second side. The connector connects the container support to a frame, and the connector is attached to the first side of the base assembly. The handle assembly has a first side and a second side. The arms are attached to the second side of the base assembly and to the first side of the handle assembly. The arms, the base assembly, and the handle assembly are movable between a closed configuration and an open configuration. The container is unsealed and open when the arms, the base assembly, and the handle assembly are in the open configuration, and the container is closed when the arms, the base assembly, and the handle assembly are in the closed configuration.

20 Claims, 20 Drawing Sheets

(56) References Cited

U.S. PATENT DOCUMENTS

| | | | | |
|---|---|---|---|---|
| 2004/0195467 | A1* | 10/2004 | Passage | B65B 67/1205 248/95 |
| 2017/0121104 | A1* | 5/2017 | Degnan | B65F 1/1415 |
| 2021/0188542 | A1* | 6/2021 | Ayers | B65F 1/1623 |

OTHER PUBLICATIONS

H20 Waterproof Magnetic Self-Sealing Gobag, https://www.scuba.com/manufacturers/h2o/bags.html?view=list, date accessed Dec. 18, 2019.

* cited by examiner

SYSTEM AND METHOD FOR A CONTAINER SUPPORT

FIELD

The field of the disclosure relates generally to container supports and, more specifically, to a system and method for a sealable container support.

BACKGROUND

Construction projects typically generate waste that is disposed of during, or at the completion of, the project. For example, waste generated during demolition is typically placed in a waste container during the construction project and disposed of on a regular basis to allow work on the project to proceed. More specifically, material waste is typically placed in an open container, such as a trash can, as the waste is generated at the project site. Once the open container has been filled to capacity with waste, the waste is emptied from the open container to another larger container, such as a dumpster, and transported away from the project site for permanent disposal. However, at least some known types of waste generate vapors that may need to be contained while work is proceeding at the project site. The open containers typically used to collect waste at construction projects do not contain the vapors because the open containers are open to the atmosphere. Additionally, at least some known sealed containers are difficult to open, load with waste, and reseal. Furthermore, workers at construction projects typically wear personal protective equipment (PPE), such as gloves that can be bulky and may make opening, loading, and resealing a sealed container difficult. Accordingly, open containers do not contain vapors generated by waste; sealed containers may be difficult to open, load, and reseal; and PPE may make opening, loading, and resealing sealed containers difficult.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION

One aspect of the present disclosure is directed to a container support for holding and closing a container. The container support includes a base assembly, a connector, a handle assembly, and a plurality of arms. The base assembly has a first side and a second side. The connector connects the container support to a frame, and the connector is attached to the first side of the base assembly. The handle assembly has a first side and a second side. The arms are attached to the second side of the base assembly and to the first side of the handle assembly. The arms, the base assembly, and the handle assembly are movable between a closed configuration and an open configuration. The container is unsealed and open when the arms, the base assembly, and the handle assembly are in the open configuration, and the container is sealed and closed when the arms, the base assembly, and the handle assembly are in the closed configuration.

Another aspect of the present disclosure is directed to a method of containing vapors generated by collected waste.

The method includes securing a container support to a frame. The container support includes a base assembly having a first side and a second side, a connector attached to the first side of the base assembly, a handle assembly having a first side and a second side, a plurality of arms attached to the second side of the base assembly and to the first side of the handle assembly, and a closer. The connector is attached to the frame. The method also includes adjusting the arms, the base assembly, and the handle assembly from a closed configuration to an open configuration. The method further includes securing a container within the container support. The method also includes adjusting the arms, the base assembly, and the handle assembly from the open configuration to the closed configuration. The container is sealed and closed such that vapors generated by collected waste are contained within the container when the arms, the base assembly, and the handle assembly are in the closed configuration.

Yet another aspect of the present disclosure is directed to a method of manufacturing a container support. The method includes attaching a connector to a first side of a base assembly. The method also includes attaching a plurality of arms to a second side of the base assembly and to a first side of a handle assembly. The method further includes attaching a closer to the second side of the base assembly and the first side of the handle assembly. The closer closes a container when the arms, the base assembly, and the handle assembly are in a closed configuration.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated examples may be incorporated into any of the above-described aspects, alone or in any combination.

Although specific features of various examples may be shown in some drawings and not in others, this is for convenience only. Any feature of any drawing may be referenced and/or claimed in combination with any feature of any other drawing.

Unless otherwise indicated, the drawings provided herein are meant to illustrate features of examples of the disclosure. These features are believed to be applicable in a wide variety of systems comprising one or more examples of the disclosure. As such, the drawings are not meant to include all conventional features known by those of ordinary skill in the art to be required for the practice of the examples disclosed herein.

DETAILED DESCRIPTION

Examples of the systems and methods described herein include a container support for holding and sealing a container configured to collect waste at a construction project. The waste generated by the construction project may generate vapor that needs to be contained. In order to contain the waste and the vapors generated by the waste, the container support holds the container such that the container support and the container are reconfigurable between an open configuration and a closed configuration. The waste is loaded into the container when the container support and the container are configured in the open configuration, and the vapors are contained in the container when the container support and the container are configured in the closed configuration. Additionally, the container support includes a closer, a handle assembly, and a plurality of arms configured to allow an operator to quickly and easily reconfigured the container support and the container between the open and closed configurations. More specifically, the closer maintains the container support and the container in the closed configuration until the operator engages the handle assembly. The arms, the handle assembly, the closer, and the container are then reconfigured in the open configuration, and the operator places the waste in the container. The operator then reengages the handle assembly such that the arms, the handle assembly, the closer, and the container are reconfigured in the closed configuration, and the vapors generated by the waste are contained in the container. Accordingly, the container support and the container are easily reconfigurable between the open configuration and the closed configuration to contain vapors generated by the waste within the container.

Figure 1:
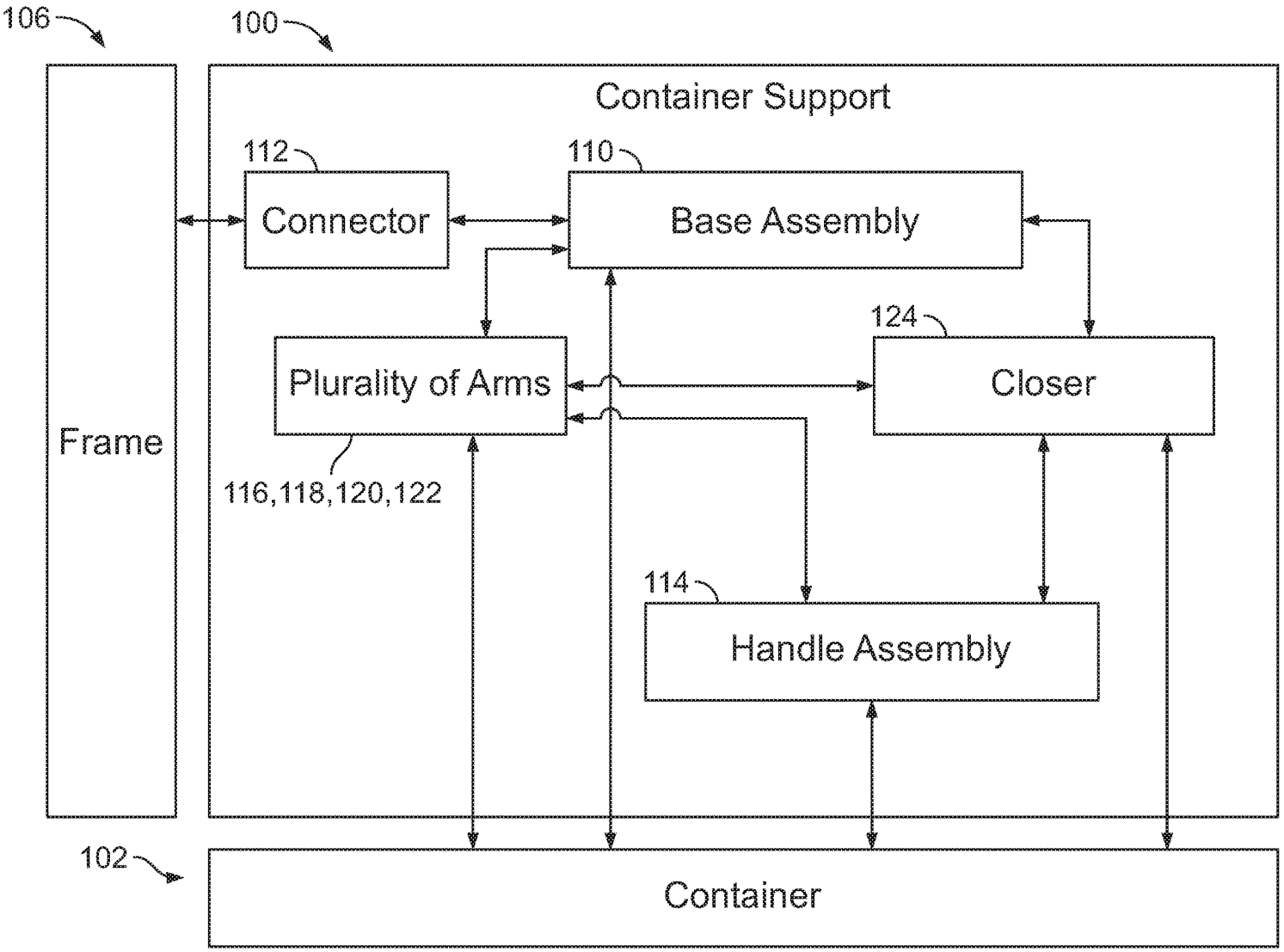
FIG. 1 is a block diagram of a container support for holding a container.
Figure 2:
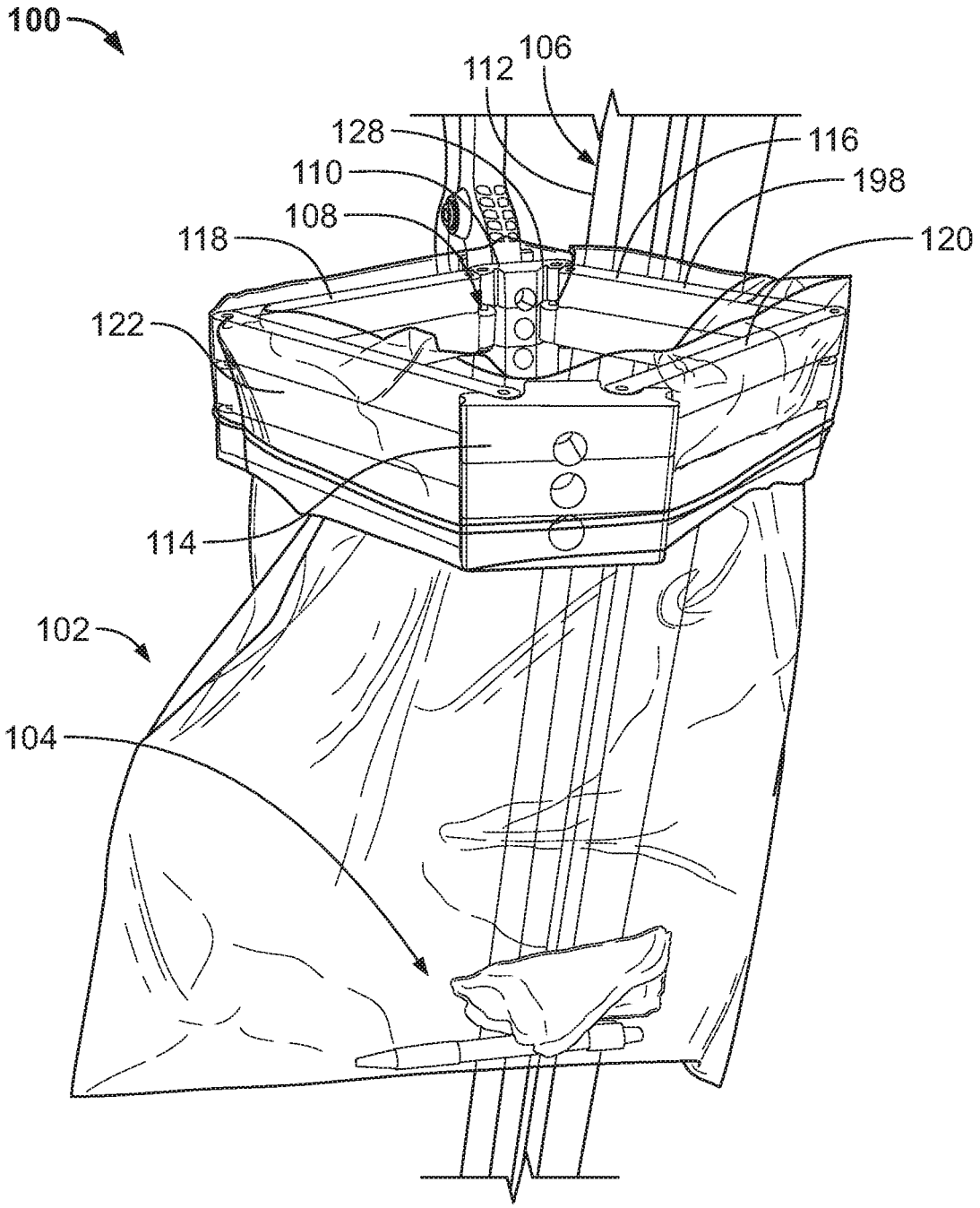
FIG. 2 is a perspective view of the container support for holding the container in an open configuration.
Figure 3:
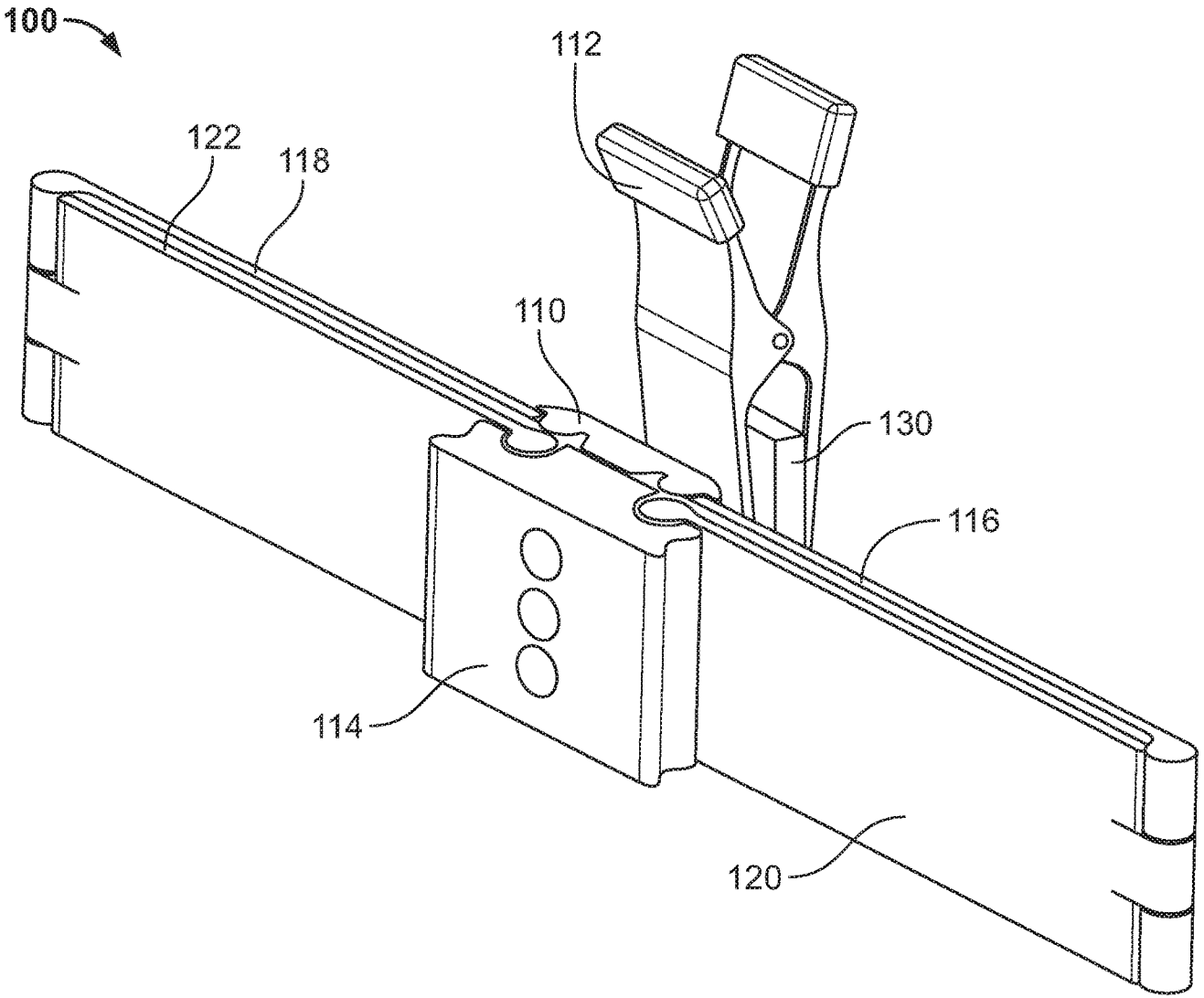
FIG. 3 is a perspective view of the container support for holding and sealing the container in a closed configuration.

FIG. 1 is a block diagram of a container support 100 for holding a container 102. FIG. 2 is a perspective view of the container support 100 for holding the container 102 in an open configuration. FIG. 3 is a perspective view of the container support 100 for holding and sealing the container 102 in a closed configuration. The container support 100 is configured to hold, support, and seal the container 102. The container 102 is configured to contain collected waste 104, and the container support 100 is configured to seal the container to prevent vapors produced by the collected waste from escaping the container. Additionally, the container support 100 is secured to a frame 106. The frame 106 is a secure structure with enough stability to maintain the container support 100 and the container 102 in an accessible location while the container 102 is filled with collected waste. The frame 106 may be, for example, a wall, a ladder, a box, a shelf, a structural support, and/or any other secure structure proximate a work area. Furthermore, as will be discussed further below, the container support 100 is removably attached to the frame 106 such that the container support and the container 102 can be moved to another secured location as the container support and the container are filled with collected waste. Accordingly, the container support 100 is easily movable to a new, easily accessible location, protects workers by sealing the container 102 such that vapors produced by the collected waste 104 are contained within the container, and supports the container during the waste collection process.

More specifically, as shown in FIGS. 2 and 3, the container support 100 is reconfigurable between the open configuration and the closed configuration. The open configuration is shown in FIG. 2, and the closed configuration is shown in FIG. 3. In the open configuration, the container support 100 is configured to maintain the container 100 in an open configuration such that the container defines an opening 108 configured to allow the collected waste 104 to be placed into the container. In the closed configuration, the container support 100 is configured to seal the container 102 such that any vapors produced by the collected waste are contained within the container while the container support and the container are in the closed configuration. As will be discussed further below, the container support 100 and the container 102 are reconfigurable between the open configuration and the closed configuration by pushing and pulling on a portion of the container support. Accordingly, the container support 100 and the container 102 are easily reconfigurable by a user with gloves on their hands.

In this example, the container 100 is a bag. However, in alternative examples, the container 100 may be any containment device that enables the container support 100 and the container 102 to operate as described herein. For example, the container 100 may be a flexible, reconfigurable box configured to contain vapors. In another example, the container 100 may be a specific type of containment bag suited to containing a specific type of waste.

The container support 100 includes a base assembly 110, a connector 112, a handle assembly 114, a plurality of arms 116, 118, 120, and 122, and a closer 124. More specifically, the container support 100 includes a first arm 116, a second arm 118, a third arm 120, and a fourth arm 122. As shown in FIGS. 2 and 3, the base assembly 110 is attached to the connector 112, and the arms 116, 118, 120, and 122 are attached to the base assembly. The arms 116, 118, 120, and 122 are attached to the handle assembly 114, and the closer 124 is attached to the base assembly 110 and the handle assembly. The arms 116, 118, 120, and 122, the base assembly 110, and the handle assembly 114 are movable between the open and closed configurations. The closer 124 seals the container 102 when the arms 116, 118, 120, and 122, the base assembly 110, and the handle assembly 114 are in the closed configuration. The container 102 is unsealed and open when the arms 116, 118, 120, and 122, the base assembly 110, and the handle assembly 114 are in the open configuration.

Figure 4:
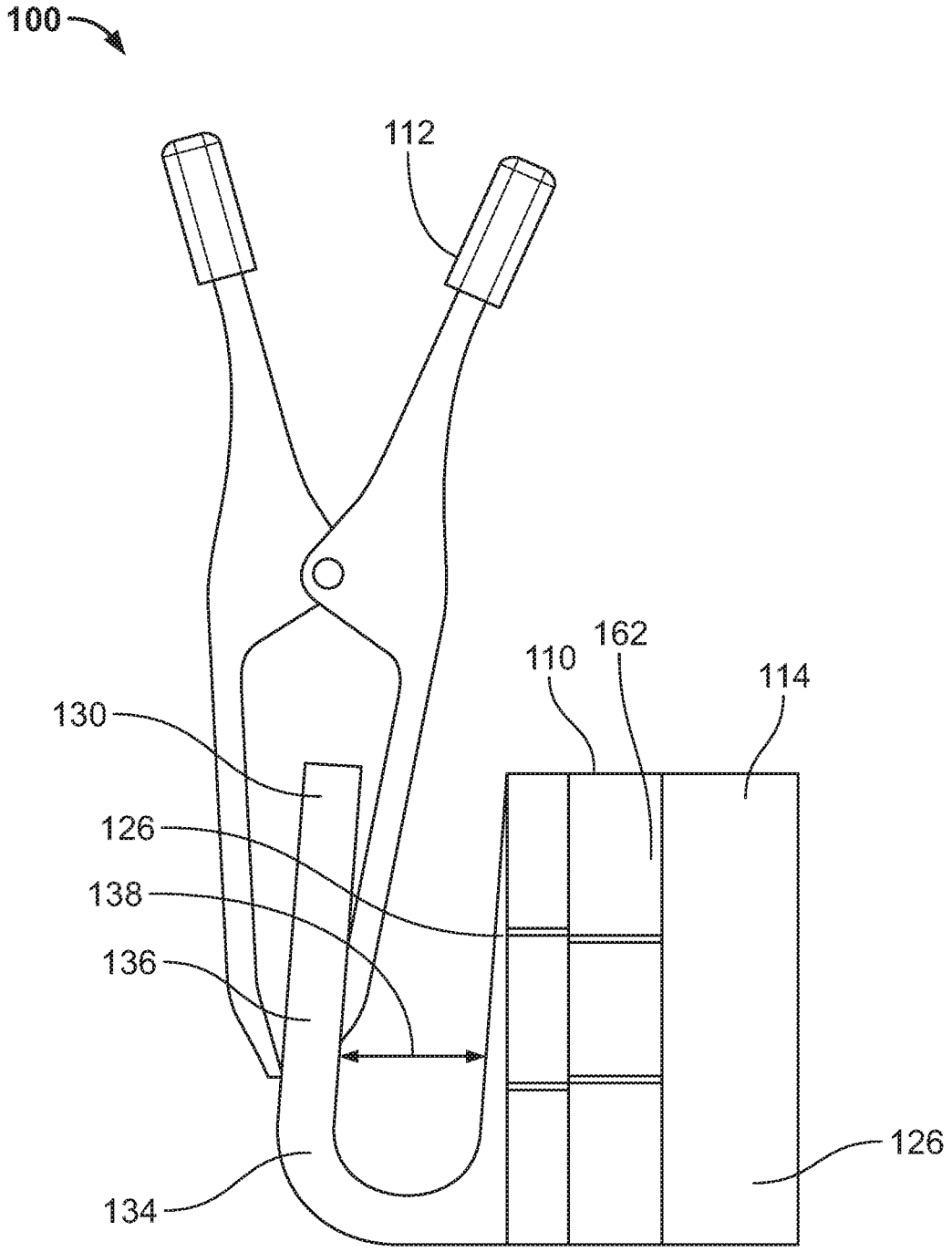
FIG. 4 is a side view of the container support in the closed configuration.
Figure 5:
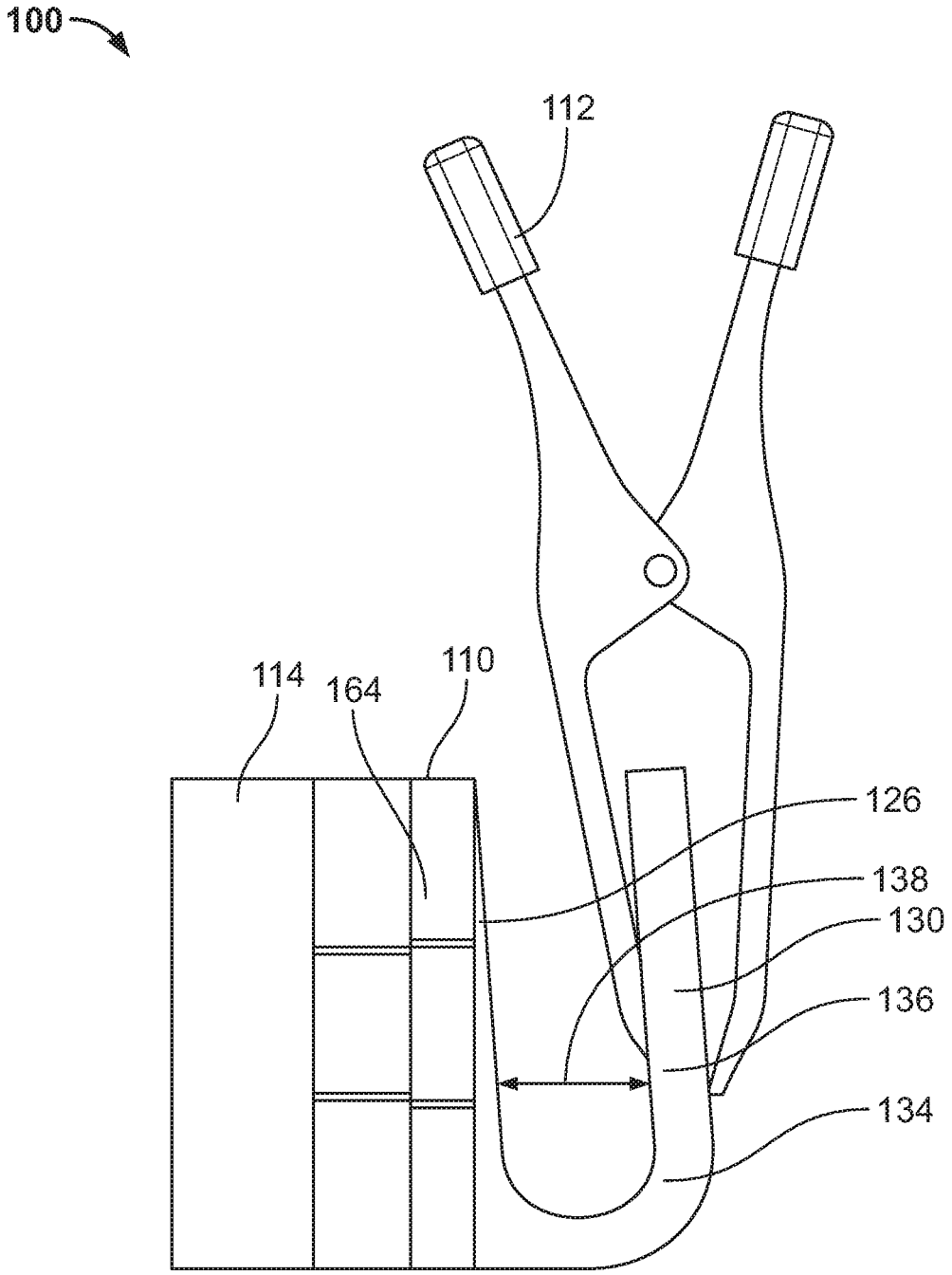
FIG. 5 is another side view of the container support in the closed configuration.
Figure 6:
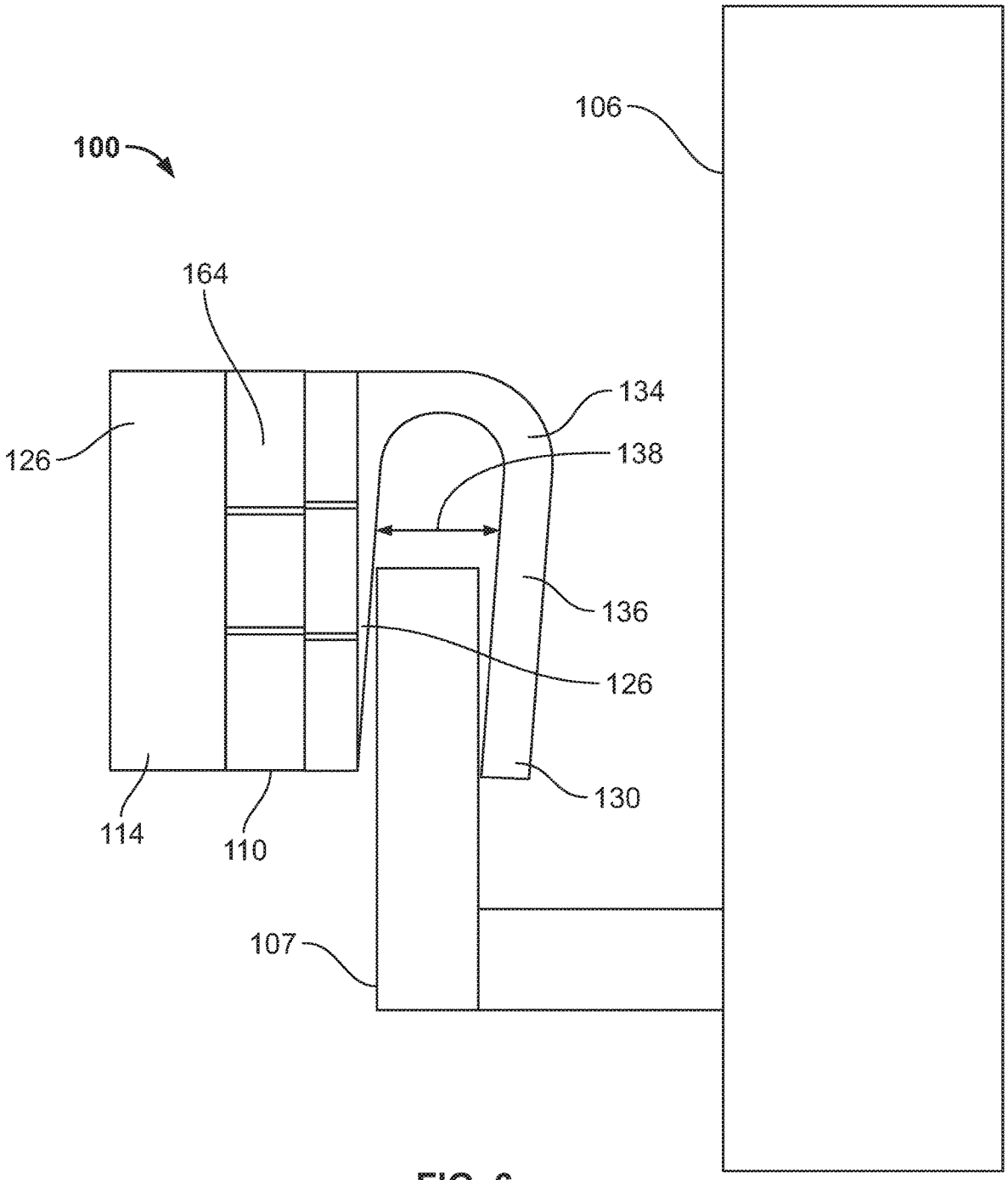
FIG. 6 is another view of the container support in the closed configuration secured to a frame.
Figure 7:
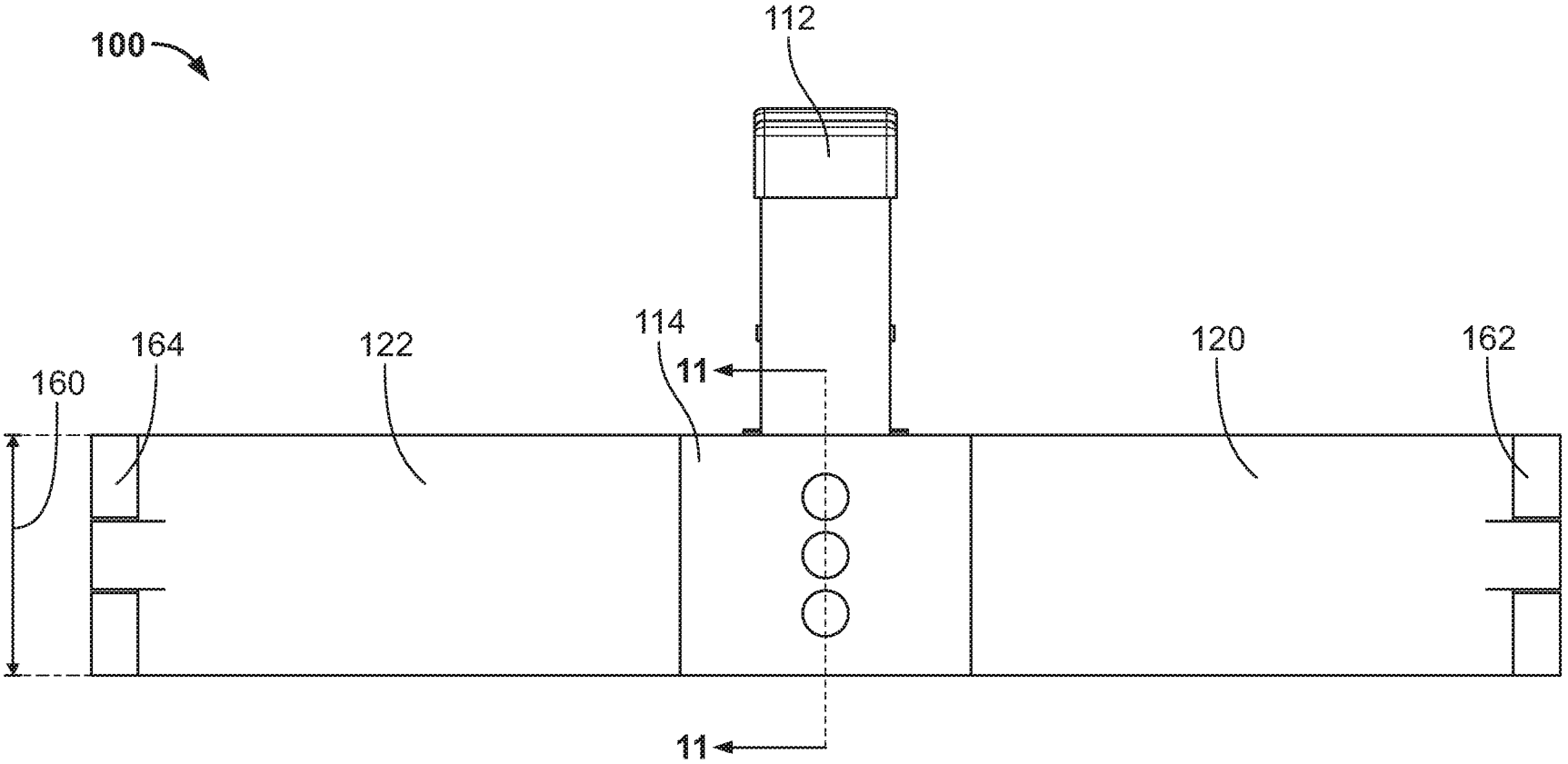
FIG. 7 is a front view of the container support in the closed configuration.
Figure 8:
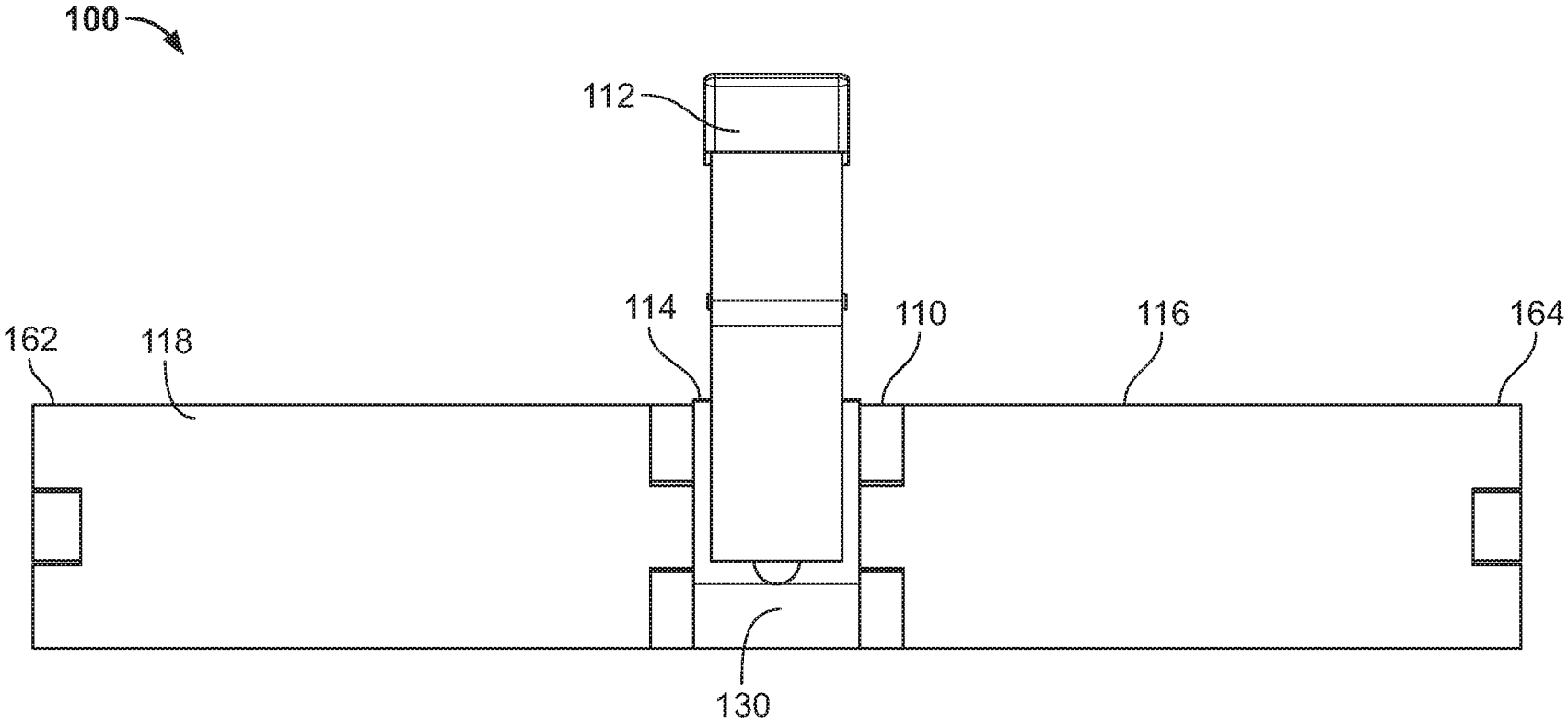
FIG. 8 is a back view of the container support in the closed configuration.
Figure 9:
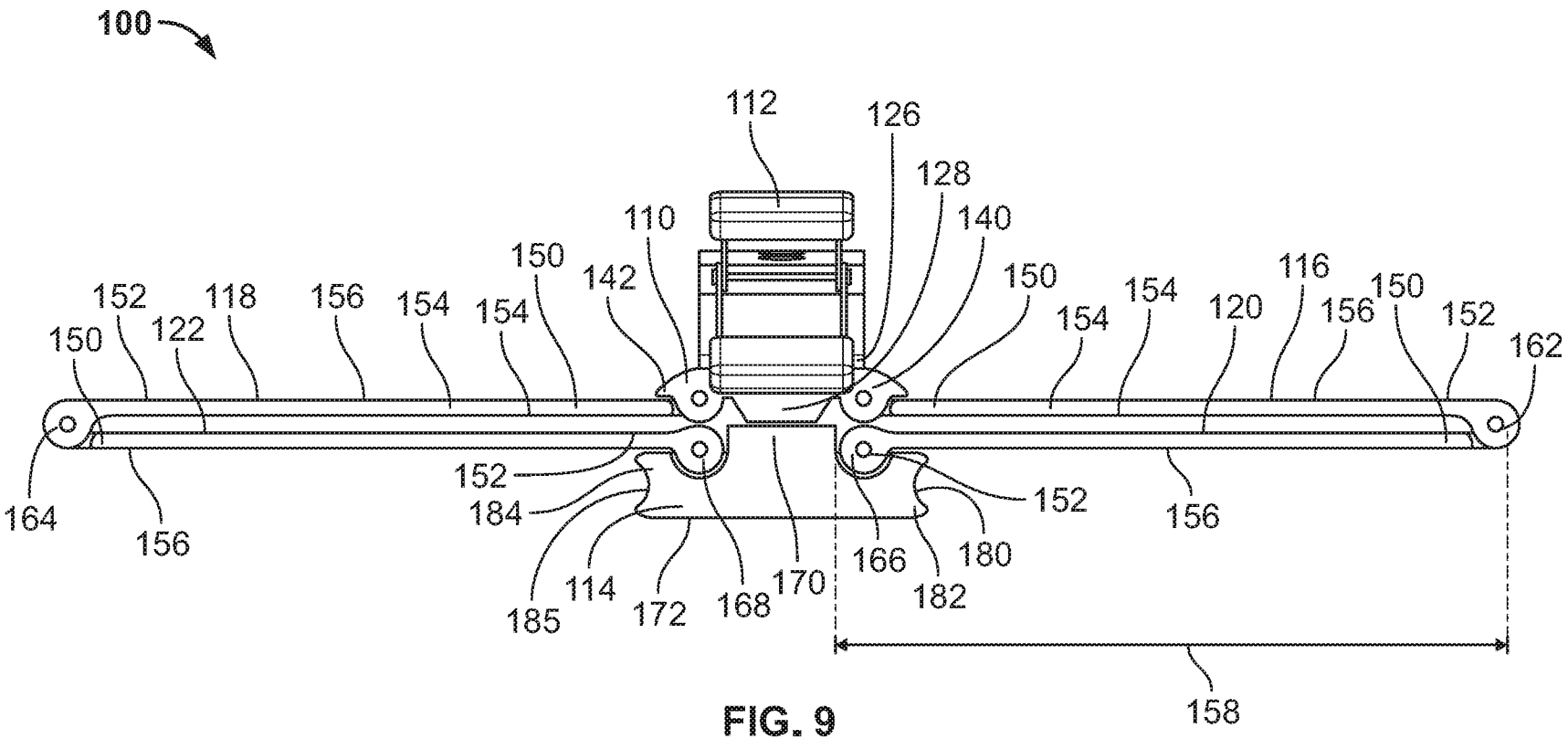
FIG. 9 is a top view of the container support in the closed configuration.
Figure 10:
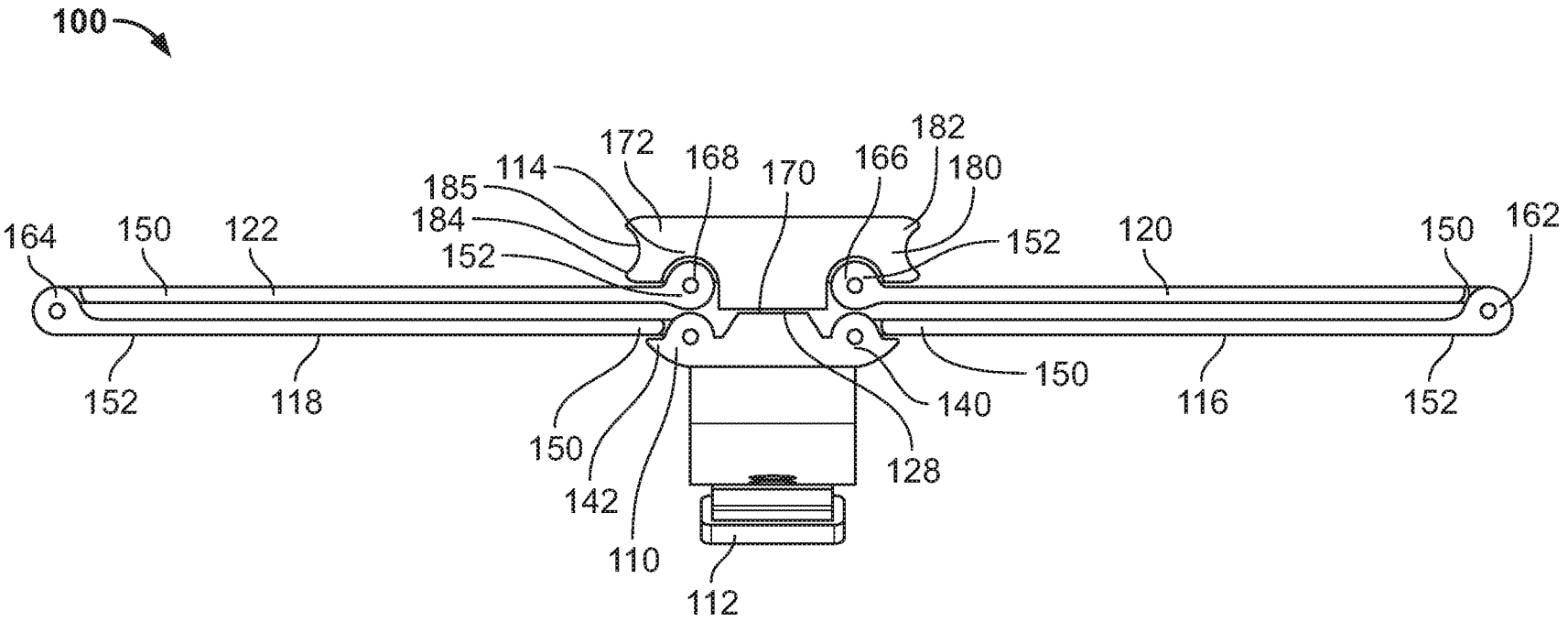
FIG. 10 is a bottom view of the container support in the closed configuration.
Figure 11:
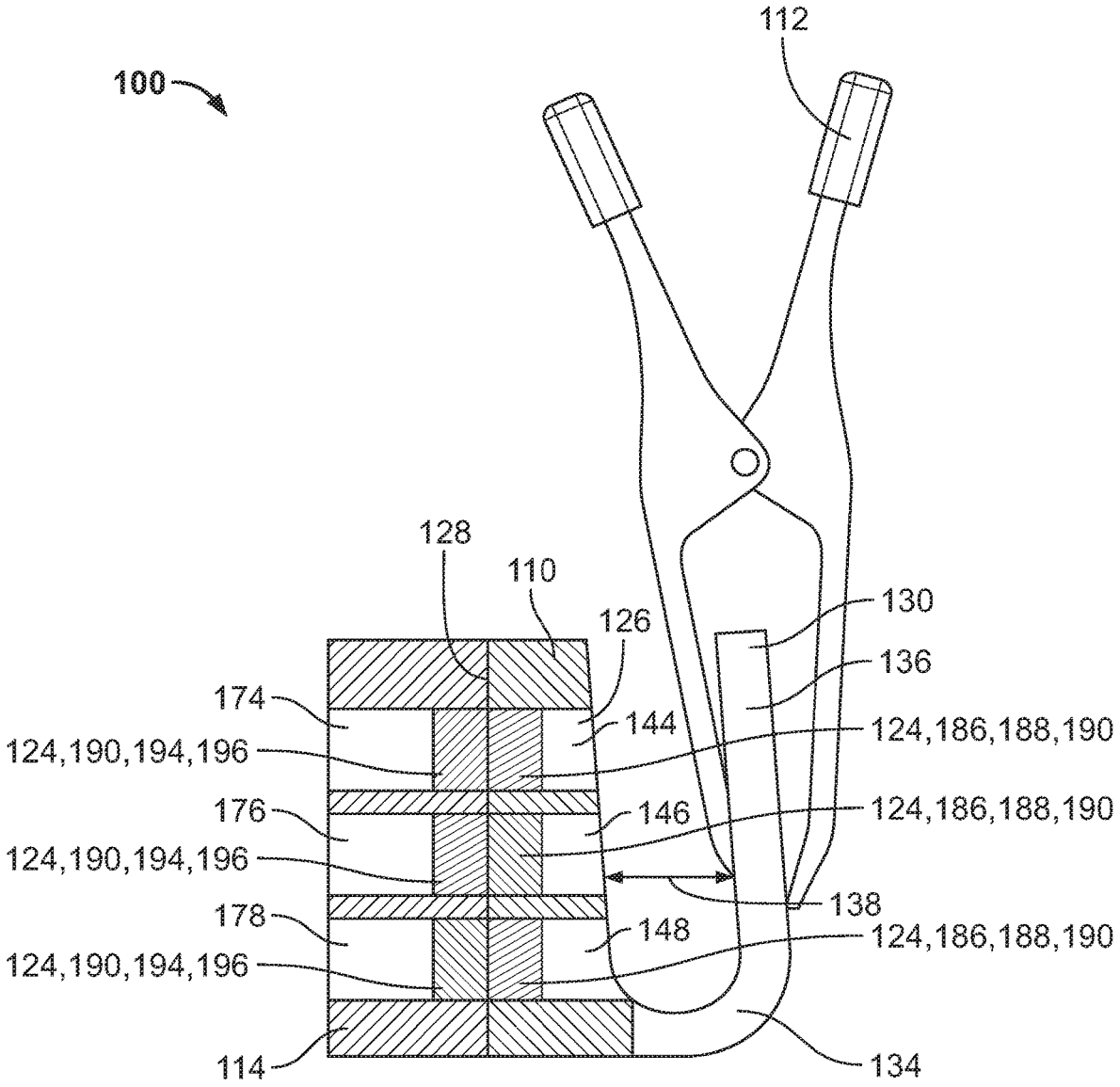
FIG. 11 is a sectional view of the container support taken along sectional line 10-10 shown in FIG. 6.
Figure 14:
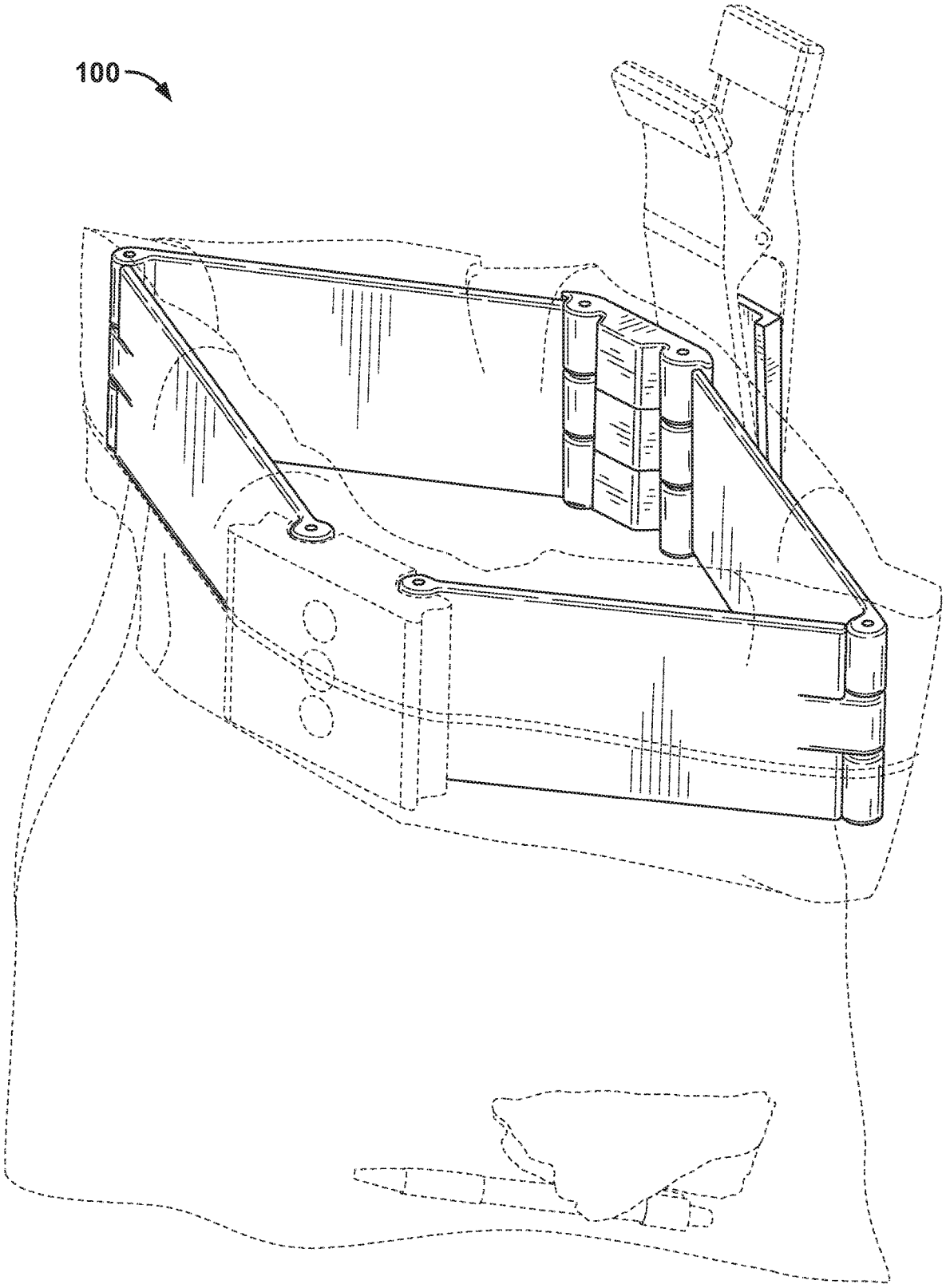
FIG. 14 is a top perspective view of a container support for holding a container in an open configuration.
Figure 15:
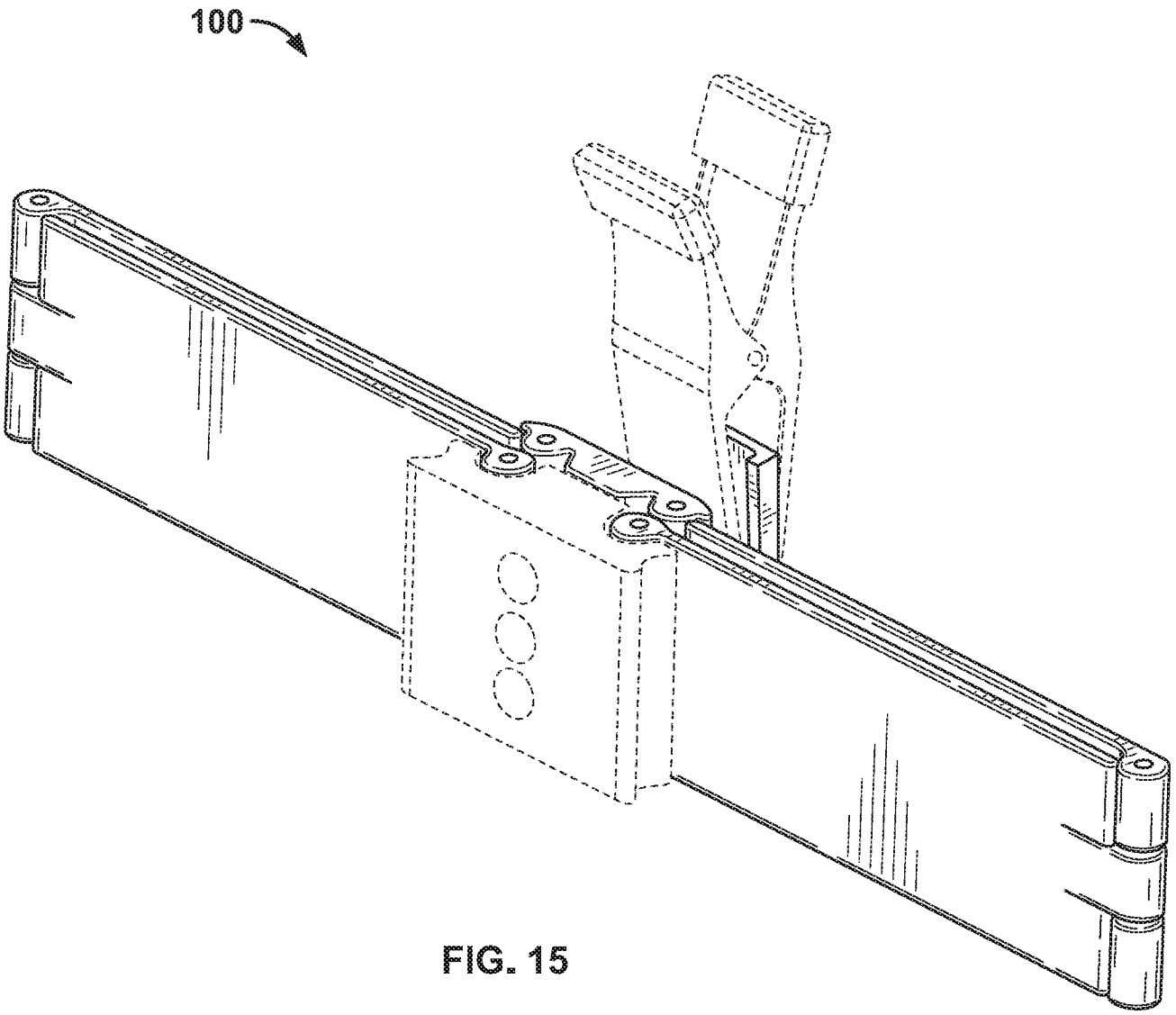
FIG. 15 is another top perspective view of the container support for holding and sealing the container of FIG. 14 in a closed configuration.
Figure 17:
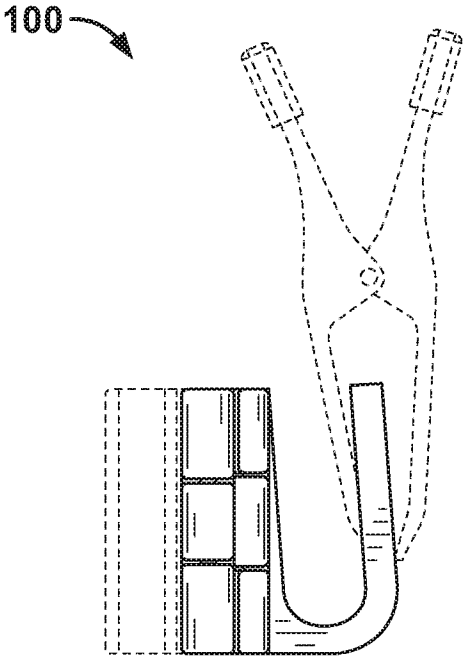
FIG. 17 is another side view of the container support of FIG. 14 in the closed configuration.
Figure 16:
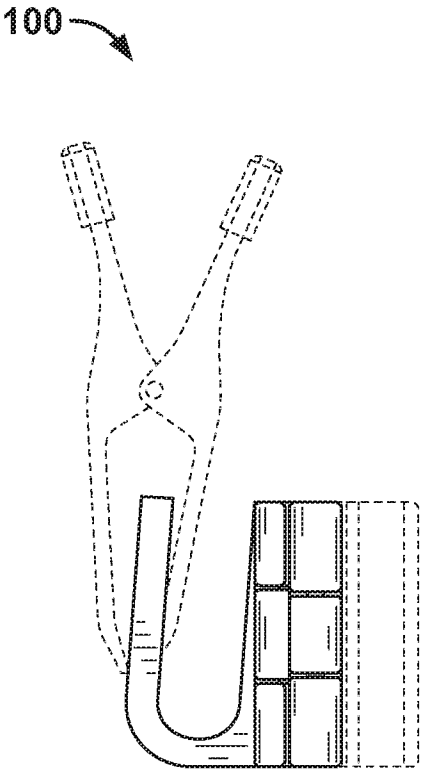
FIG. 16 is a side view of the container support of FIG. 14 in the closed configuration.
Figure 18:
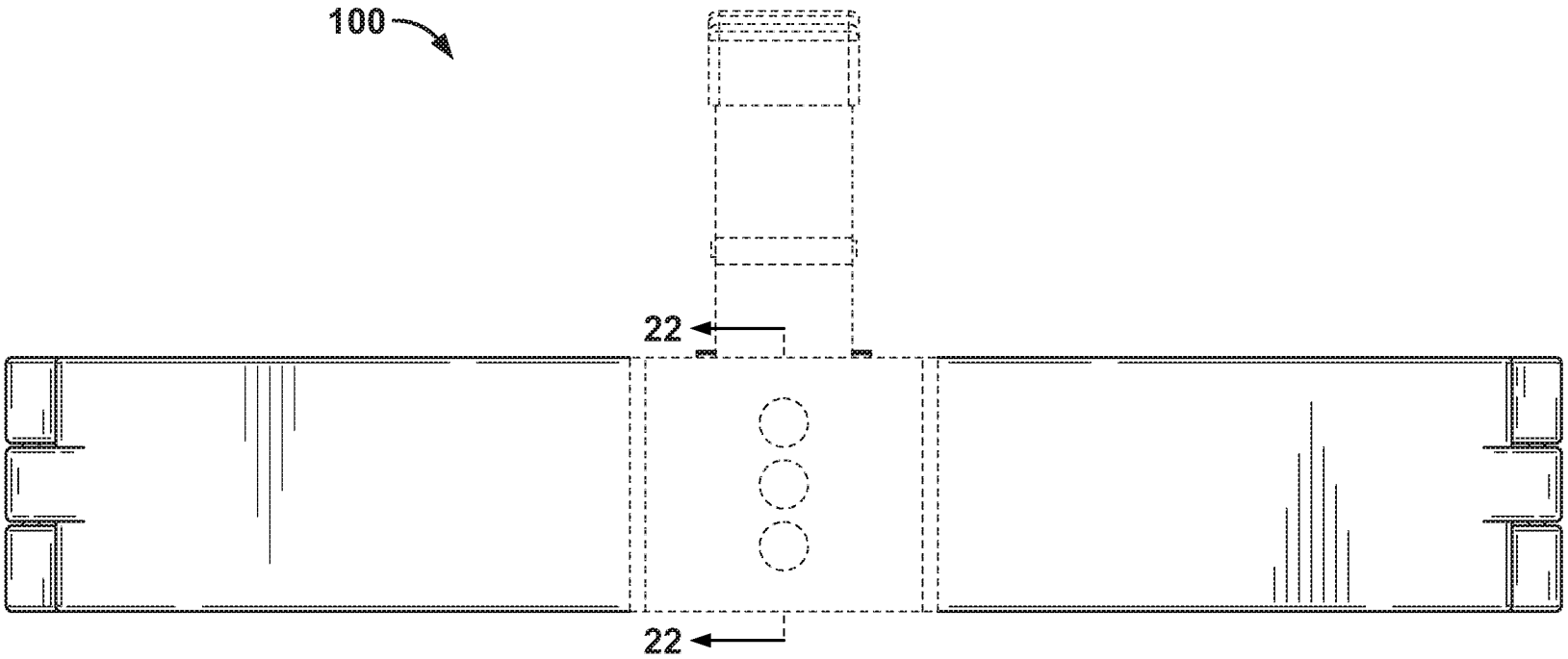
FIG. 18 is a front view of the container support of FIG. 14 in the closed configuration.
Figure 19:
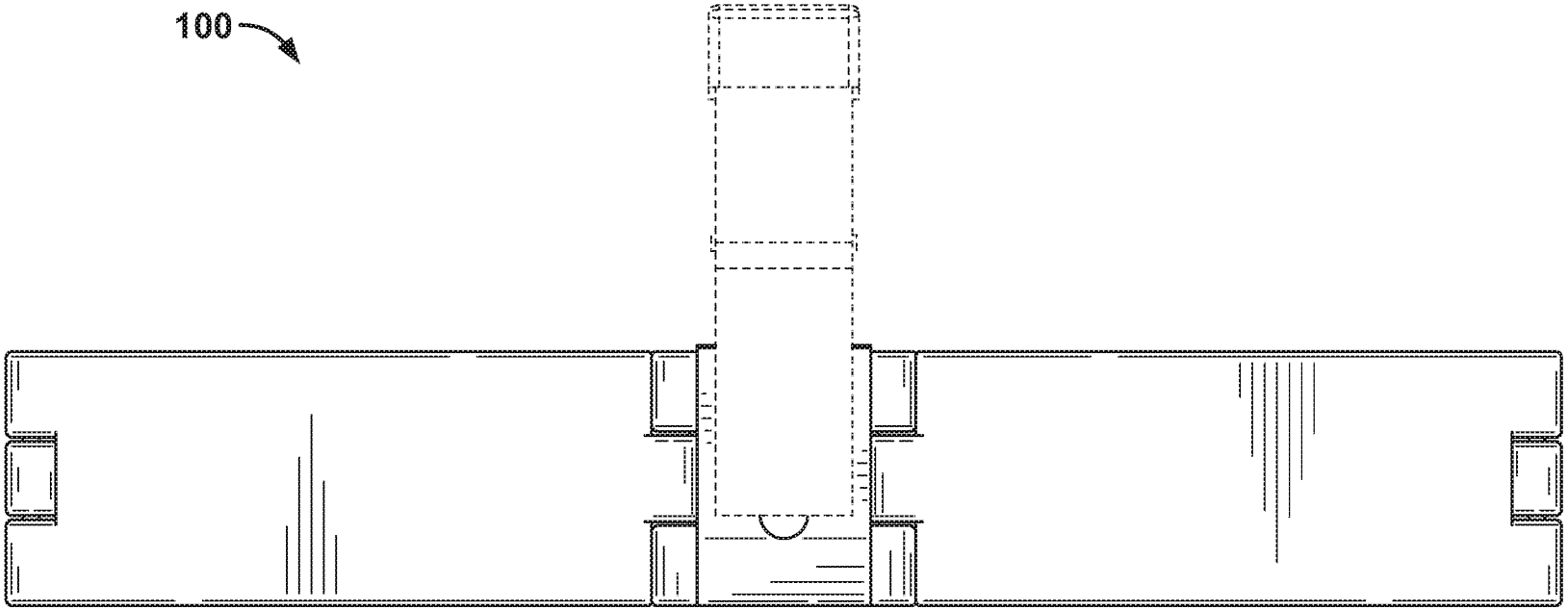
FIG. 19 is a back view of the container support of FIG. 14 in the closed configuration.
Figure 20:
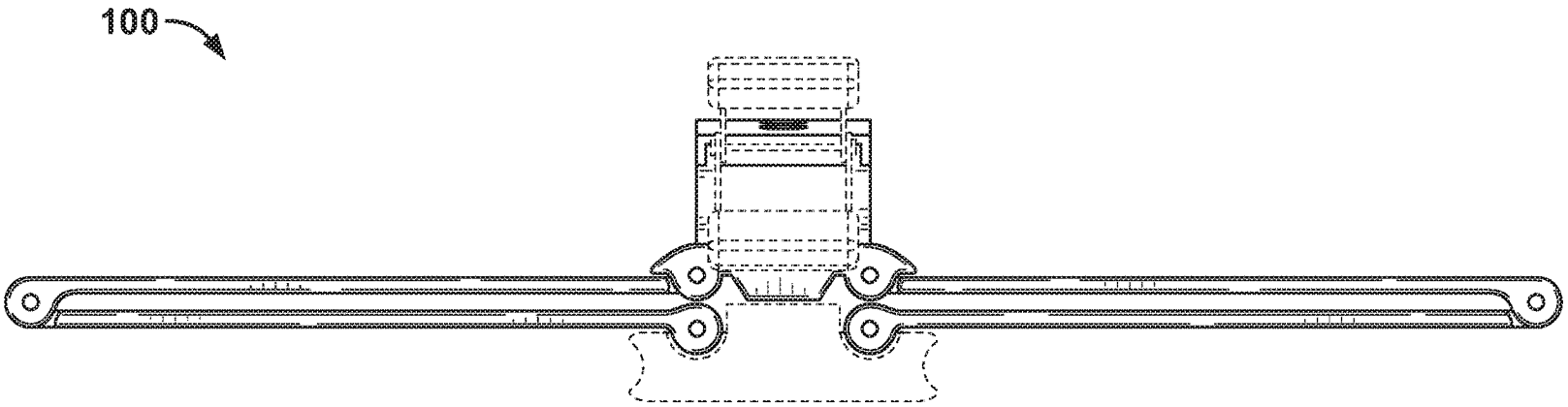
FIG. 20 is a top view of the container support of FIG. 14 in the closed configuration.
Figure 21:
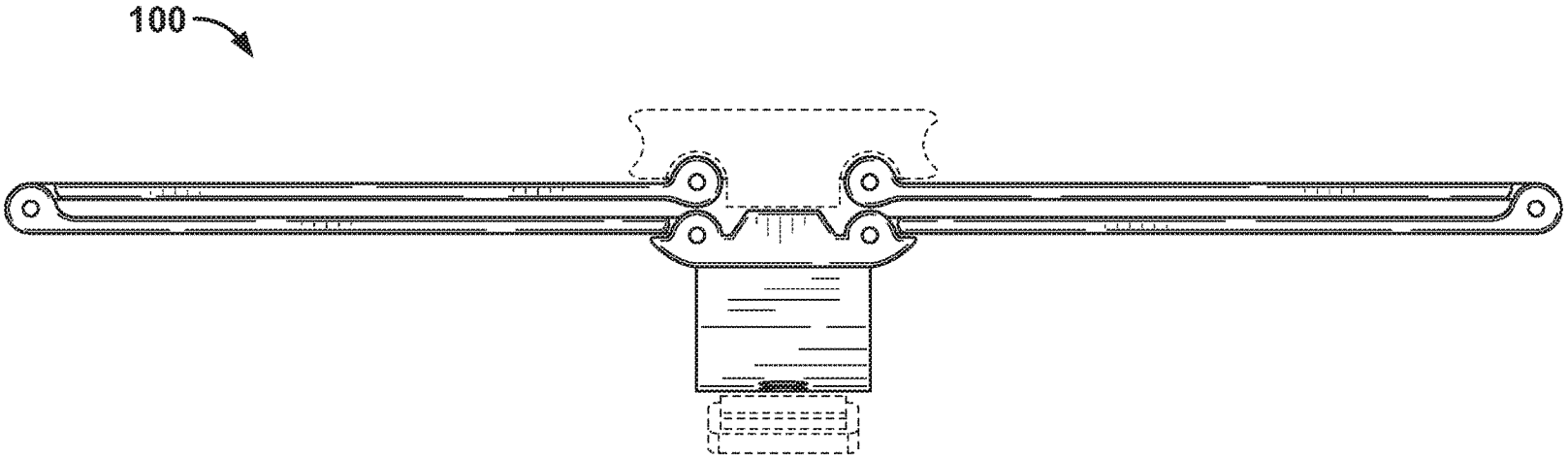
FIG. 21 is a bottom view of the container support of FIG. 14 in the closed configuration.
Figure 22:
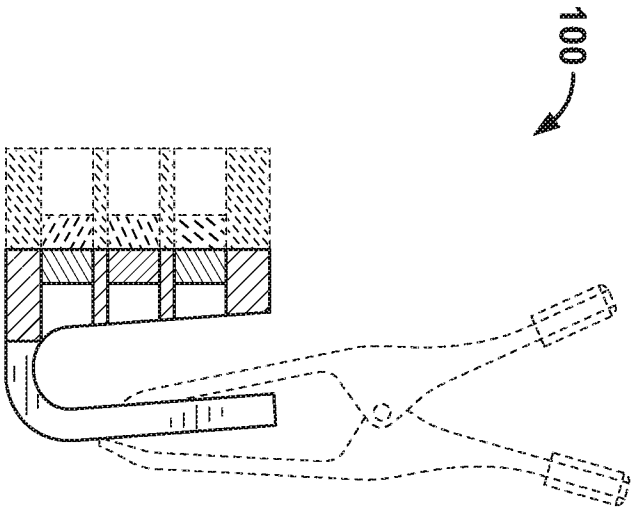
FIG. 22 is a sectional view of the container support taken along sectional line 22-22 of FIG. 18.

FIG. 4 is a side view of the container support 100 in the closed configuration. FIG. 5 is another side view of the container support 100 in the closed configuration. FIG. 6 is another view of the container support in the closed configuration secured to a frame. FIG. 7 is a front view of the container support 100 in the closed configuration. FIG. 8 is a back view of the container support 100 in the closed configuration. FIG. 9 is a top view of the container support 100 in the closed configuration. FIG. 10 is a bottom view of the container support 100 in the closed configuration. FIG. 11 is a sectional view of the container support 100 taken along sectional line 11-11 shown in FIG. 7. FIG. 14 is a top perspective view of the container support 100 for holding the container 102 in an open configuration. FIG. 15 is another top perspective view of the container support 100 for holding and sealing the container 102 of FIG. 14 in a closed configuration. FIG. 16 is a side view of the container support 100 of FIG. 14 in the closed configuration. FIG. 17 is another side view of the container support 100 of FIG. 14 in the closed configuration. FIG. 18 is a front view of the container support 100 of FIG. 14 in the closed configuration. FIG. 19 is a back view of the container support 100 of FIG. 14 in the closed configuration. FIG. 20 is a top view of the container support 100 of FIG. 14 in the closed configuration. FIG. 21 is a bottom view of the container support 100 of FIG. 14 in the closed configuration. FIG. 22 is a sectional view of the container support 100 taken along sectional line 22-22 of FIG. 18.

As shown in FIGS. 2-11, the base assembly 110 is secured to the frame 106, and the arms 116, 118, 120, and 122 and the handle assembly 114 are attached to, and extend from, the base assembly. As such, the base assembly 110 is the point of attachment to the frame 106. The base assembly 110 includes a first side 126 and a second side 128 opposite the first side. The first side 126 includes a connector extension 130 extending from the first side. In this example, the connector extension 130 is a curved extension that includes a curved portion 134 and a flat portion 136 that interfaces with the frame 106. More specifically, the curved portion 134 is attached to, and extends from, the first side 126, and the flat portion 136 is attached to, and extends from, the curved portion. The curved portion 134 curves such that the flat portion is substantially parallel to the first side 126. Accordingly, the first side 126, the curved portion 134, and the flat portion 136 define a gap 138 configured to receive a portion of the connector 112 in order to facilitate attaching the base assembly 110 to the frame.

The second side 128 includes a plurality of hinges 140, 142 and at least one base assembly receptacle 144, 146, and 148. In this example, the second side 128 includes a plurality of base assembly receptacles 144, 146, and 148. More specifically, the second side 128 includes a first hinge 140, a second hinge 142, a first base assembly receptacle 144, a second base assembly receptacle 146, and a third base assembly receptacle 148. The first hinge 140 is attached to the first arm 116 such that the first arm 116 is hinged to the second side 128, and the second hinge 142 is attached to the second arm 118 such that the second arm 118 is also hinged to the second side 128. Thus, the first arm 116 and the second arm 118 extend from the second side 128 and are movable relative to the second side. However, the second side 128 may include any number of hinges and may include any number of arms extending from the second side that enables the base assembly 110 to operate as described herein. The base assembly receptacles 144, 146, and 148 are configured to receive the closer 124 as described below. The second side 128 may include any number of base assembly receptacles that enable the base assembly 110 to operate as described herein.

In this example, the connector 112 is a clamp configured to secure the connector extension 130 and the base assembly 110 to the frame 106. More specifically, the flat portion 136 of the connector extension 130 is positioned against the frame 106, and the clamp extends over the flat portion 136 of the connector extension 130 and a portion (not shown) of the frame 106 such that the clamp maintains the position of the connector extension 130 relative to the frame 106. In alternative examples, the connector 112 may be any connection device that secures the container support 100 to the frame 106. For example, the connector 112 may be a mount including a clamp, a hook, and/or an adhesive. If the connector 112 is a clamp, the clamp may include at least one of a spring clamp, a screw clamp, a C-clamp, a bar clamp, and a magnetic clamp. If the connector 112 is a hook, the hook may include at least one of a S-hook, a cup hook, a carabiner, and a door hook. If the connector 112 is an adhesive, the adhesive may include at least one of an adhesive tape, a pressure sensitive adhesive, and a removable adhesive. The connector 112 is removable from the frame 106 such that the container support 100 is movable to other locations proximate a work area. Additionally, the connector 112 is removable from the container support 100 such that a different type of connector can be used to attach the container support 100 to a different frame 106. That is, some frames 106 better suited to adhesive type connectors 112 than clamp type connectors. A user can remove the clamp connector 112 and replace it with the adhesive connector when the working location is better suited to the adhesive connector. In an alternative example, the connector 112 includes a stand (not shown) rather than being attached to the frame 106. The stand sits on the floor and supports the container support 100 in a similar manner as the frame 106.

In an alternative example, the container support 100 is secured to the frame 106 without the connector 112. Specifically, as shown in FIG. 6, the container support 100 is inverted such that the connector extension 130 is inverted, forming a hook. The frame 106 may include a lip or projection 107, and the connector extension 130 is hooked to the lip 107. Accordingly, the container support 100 may be secured to the frame 106 without the connector 112, and may be easily moved to other working locations by unhooking the container support 100 and rehooking the container support 100 at another location.

The arms 116, 118, 120, and 122 each include a first end 150, a second end 152, an inner surface 154, an outer surface 156, a length 158, and a height 160. In this example, the length 158 and the height 160 of the arms 116, 118, 120, and 122 is the same. In alternative examples, the length 158 and the height 160 of the arms 116, 118, 120, and 122 may be different. In this example, the length 158 is about 5 inches to about 6 inches, and the height 160 is about 1 inch to about 3 inches. However, the arms 116, 118, 120, and 122 may have any length 158 and height 160 that enables the arms 116, 118, 120, and 122 to operate as described herein.

The first end 150 of the first arm 116 is attached to the first hinge 140 such that the first arm 140 is hinged to the second side 128. The second end 152 of the first arm 116 forms a portion of a third hinge 162. Similarly, the first end 150 of the second arm 118 is attached to the second hinge 142 such that the second arm 118 is hinged to the second side 128. The second end 152 of the second arm 118 forms a portion of a fourth hinge 164. The first end 150 of the third arm 120 forms a portion of the third hinge 162 and is attached to the third hinge 162 such that the third arm 120 is hinged to the first arm 116. The second end 152 of the third arm 120 forms a portion of a fifth hinge 166 and is attached to the handle assembly 114. Similarly, the first end 150 of the fourth arm 122 forms a portion of the fourth hinge 164 and is attached to the fourth hinge 164 such that the fourth arm 122 is hinged to the second arm 118. The second end 152 of the fourth arm 122 forms a portion of a sixth hinge 168 and is attached to the handle assembly 114. As shown in FIG. 2, the first arm 116 is positioned opposite the third arm 120, and the second arm 118 is positioned opposite the fourth arm 122. More specifically, the first arm 116 is positioned relative to the third arm 120 such that the inner surface 154 of the first arm 116 faces the inner surface 154 of the third arm 120. Similarly, the second arm 118 is positioned relative to the fourth arm 122 such that the inner surface 154 of the second arm 118 faces the inner surface 154 of the fourth arm 122. Additionally, while the container support 100 is illustrated as including four arms 116, 118, 120, and 122, the container support 100 may include any number of arms that enables the container support to operate as described herein.

The handle assembly 114 includes a first side 170 and a second side 172 opposite the first side. The first side 170 includes a plurality of hinges 166, 168 and at least one handle assembly receptacle 174, 176, and 178. In this example, the first side 170 includes a plurality of handle assembly receptacles 174, 176, and 178. More specifically, the first side 170 includes the fifth hinge 166, the sixth hinge 168, a first handle assembly receptacle 174, a second handle assembly receptacle 176, and a third handle assembly receptacle 178. The fifth hinge 166 is attached to the third arm 120 such that the third arm 120 is hinged to the first side 170, and the sixth hinge 168 is attached to the fourth arm 122 such that the fourth arm 122 is also hinged to the first side 170. Thus, the third arm 120 and the fourth arm 122 extend from the first side 170 and are movable relative to the first side. However, the first side 170 may include any number of hinges and may include any number of arms extending from the first side that enables the handle assembly 114 to operate as described herein. The handle assembly receptacle 174, 176, and 178 are configured to receive the closer 124 as described below. The first side 170 may include any number of handle assembly receptacles that enable the handle assembly 114 to operate as described herein.

In the illustrated example, the second side 172 is substantially flat. However, in an alternative example, the second side 172 may include a handle (not shown) extending from the second side. The handle may include an ergonomic shape configured to enable a user to grab the handle and reconfigured the container support 100 into either the open or closed configuration. In the illustrated example, the handle assembly 114 includes a first indentation 180 formed in a first edge 182 of the handle assembly and a second indentation 184 formed in a second edge 185 of the handle assembly. The indentations 180 and 184 have an ergonomic shape configured to enable a user's fingers to grab the handle assembly 114 and reconfigured the container support 100 into either the open or closed configuration. In an alternative example, the handle assembly 114 does not include a handle or indentations 180 and 184. Rather, the handle assembly 114 is a block that the user grabs.

In this example, the closer 124 includes a plurality of magnets 186, 188, 190, 192, 194, and 196 positioned within the base assembly receptacles 144, 146, and 148 and the handle assembly receptacles 174, 176, and 178. More specifically, the closer 124 includes a first magnet 186 positioned within the first base assembly receptacle 144, a second magnet 188 positioned within the second base assembly receptacle 146, a third magnet 190 positioned within the third base assembly receptacle 148, a fourth magnet 192 positioned within the first handle assembly receptacle 174, a fifth magnet 194 positioned within the second handle assembly receptacle 176, and a sixth magnet 196 positioned within the third handle assembly receptacle 178. The first, second, and third magnets 186, 188, and 190 have a first polarity, and the fourth, fifth, and sixth magnets 192, 194, and 196 have a second polarity opposite the first polarity.

The first, second, and third magnets 186, 188, and 190 are magnetically attracted to the fourth, fifth, and sixth magnets 192, 194, and 196 and pull the handle assembly 114 toward the base assembly 110. Thus, when the magnets 186, 188, 190, 192, 194, and 196 are moved close enough to each other such that the magnetic force between the magnets attracts the magnets to each other, the handle assembly 114 is automatically moved toward the base assembly 110 such that the container support 100 is moved into the closed configuration, and the container 102 is closed. The magnetic force between the magnets 186, 188, 190, 192, 194, and 196 is not too strong such that a user cannot disengage the first, second, and third magnets 186, 188, and 190 from the fourth, fifth, and sixth magnets 192, 194, and 196, reconfiguring the container support 100 into the open configuration, and opening the container 102. Additionally, the magnet force between the magnets 186, 188, 190, 192, 194, and 196 may be adjusted by adding or removing the magnets from the base assembly receptacles 144, 146, and 148 and the handle assembly receptacles 174, 176, and 178. More specifically, if the magnetic force is too strong such that a user has difficulty reconfiguring the container support 100, the user can remove one or more magnets 186, 188, 190, 192, 194, and 196 such that the magnetic force is reduced and the container support 100 is easier to reconfigure. Conversely, if the magnetic force is too weak such that the container support 100 does not remain in the closed configuration when closed by the user, the user can add one or more magnets 186, 188, 190, 192, 194, and 196 such that the magnetic force is increase and the container support 100 remains in the closed configuration.

The closer 124 may be any device that maintains the container support 100 in the closed configuration when closed and allows the container support 100 to be reconfigured in the open configuration when opened. For example, rather than the magnets 186, 188, 190, 192, 194, and 196 located within the base assembly 110 and the handle assembly 114, the closer 124 may include at least one push-to-open hinge (not shown). More specifically, any or all of the hinges 140, 142, 162, 164, 166, and 168 may be a push-to-open hinge. A push-to-open hinge automatically opens when tapped or pushed by a user and closes when pushed by the user. Accordingly, a user taps the container support 100 to disengage the push-to-open hinge, which then automatically opens, and pushed the container support 100 to engage the push-to-open hinge such that the container support 100. In another alternative example, the closer 124 is a plurality of magnets (not shown) positioned on the inner surface 154 of the arms 116, 118, 120, and 122. In another alternative example, any or all of the hinges 140, 142, 162, 164, 166, and 168 may include a detent (not shown) that maintains the container support 100 in the closed configuration when closed and allows the container support 100 to be reconfigured in the open configuration when opened. Additionally, the detent may also maintain the arms 116, 118, 120, and 122 in the open configuration.

During operation, the container support 100 is positioned against the frame 106, and the connector 112 attached the container support to the frame by attaching the connector extension 130 to a portion of the frame. In the illustrated example, a clamp clamps the connector extension 130 to the portion of the frame 106. The user moves the handle assembly 114 away from the base assembly 110 such that the closer 124 disengages and the container support 100 is reconfigured into the open configuration. The user inserts the container 102 into the container support 100. More specifically, in the illustrated example, the container 102 is a bag, and the user inserts the bag into the container support 100. The user then folds a top 198 of the bag over the handle assembly 114, the arms 116, 118, 120, and 122, and at least a portion of the base assembly 110 such that the bag covers the handle assembly 114, the arms 116, 118, 120, and 122, and at least a portion of the base assembly 110. Covering the handle assembly 114, the arms 116, 118, 120, and 122, and at least a portion of the base assembly 110 with the bag protects the container support 100 from harmful waste and prevents the waste from getting on the container support such that the container support can be reused with a different bag. Additionally, folding the bag over the handle assembly 114, the arms 116, 118, 120, and 122, and at least a portion of the base assembly 110 maintains the bag in position while the collected waste 104 is placed in the bag.

The user then moves the handle assembly 114 toward the base assembly 110 such that the arms 116, 118, 120, and 122 rotate about the hinges 140, 142, 162, 164, 166, and 168. More specifically, the arms 116, 118, 120, and 122 rotate about the hinges 140, 142, 162, 164, 166, and 168 such that the inner surface 154 of the first arm 116 contacts the inner surface 154 of the third arm 120 through the bag and the inner surface 154 of the second arm 118 contacts the inner surface 154 of the fourth arm 122 through the bag. Additionally, as the handle assembly 114 moves toward the base assembly 110, the closer 124 engages such that the handle assembly 114 is pulled toward the base assembly 110. More specifically, once the handle assembly 114 has moved close enough to the base assembly 110, the magnets 186, 188, 190, 192, 194, and 196 attract each other and the container support 100 automatically closes into the closed configuration.

The user then collects the collected waste 104 and reconfigures the container support 100 into the open configuration. Specifically, the user moves the handle assembly 114 away from the base assembly 110 such that the closer 124 disengages and the handle assembly 114 is no longer attracted to the base assembly 110 by the magnetic force of the magnets 186, 188, 190, 192, 194, and 196. More specifically, in order to prevent the collected waste 104 from contaminating the container support 100, the user grabs the handle assembly 114 through the bag and pulls the handle assembly away from the base assembly 110 such that the closer 124 disengages and the handle assembly 114 is no longer attracted to the base assembly 110 by the magnetic force of the magnets 186, 188, 190, 192, 194, and 196. The user then places the collected waste 104 in the bag.

The user then reconfigures the container support 100 into the closed configuration. Specifically, the user moves the handle assembly 114 toward the base assembly 110 such that the closer 124 engages and the handle assembly 114 is attracted to the base assembly 110 by the magnetic force of the magnets 186, 188, 190, 192, 194, and 196. More specifically, in order to prevent the collected waste 104 from contaminating the container support 100, the user grabs the handle assembly 114 through the bag and pushes the handle assembly toward the base assembly 110 such that the closer 124 engages and the handle assembly 114 is attracted to the base assembly 110 by the magnetic force of the magnets 186, 188, 190, 192, 194, and 196. The magnetic force of the magnets 186, 188, 190, 192, 194, and 196 then pulls the container support 100 into the closed configuration. The bag is also closed in the closed configuration and prevents vapors generated by the collected waste 104 from escaping the bag. In some examples, the closer 124 may close the bag with enough force to substantially or completely seal the bag and prevent harmful vapors from escaping the bag. Accordingly, the bag and the container support 100 substantially seal the bag, preventing harmful vapors from escaping the bag and improving the environment around the working location.

When the bag is full, or the work is complete, the user may remove the bag by reconfiguring the container support 100 into the open configuration as described above, unfolding the bag such that the top 198 of the bag in not folded over the handle assembly 114, the arms 116, 118, 120, and 122, and at least a portion of the base assembly 110, and pulling the bag out of the container support 100. The user may then inert a new bag into the container support 100 as described above. Additionally, the user may relocate the container support 100 to work in a new location. Specifically, the user may disengage the connector 112 such that the container support 100 is no longer attached to the frame 106. The user then moves the container support 100 to a new location with a new frame 106, and attaches the container support 100 to the new frame 106 as described above.

Figure 12:
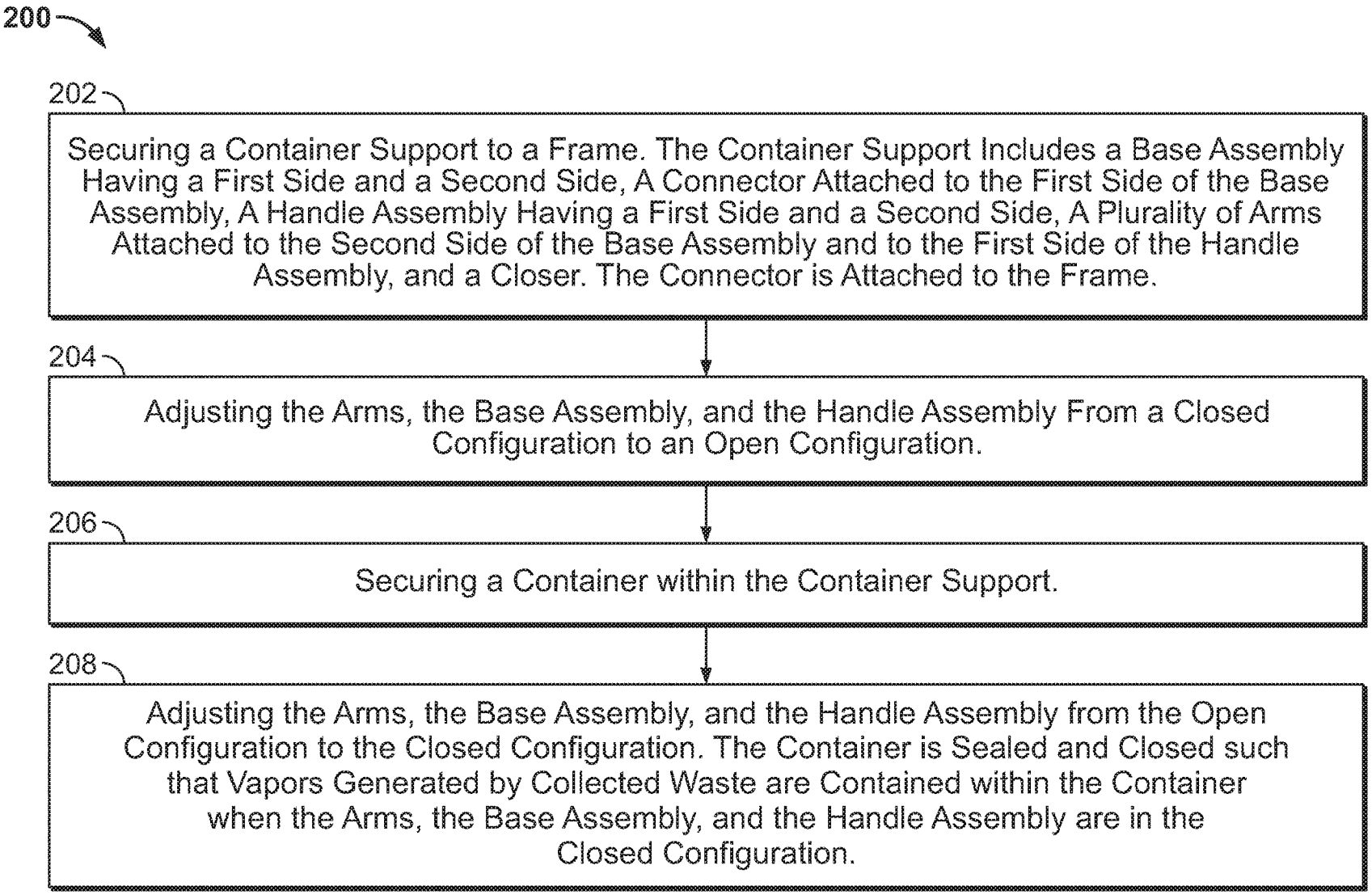
FIG. 12 is a flow diagram of an example of a method of containing vapors generated by collected waste.

FIG. 12 is a flow diagram of an example of a method 200 of containing vapors generated by collected waste. The method includes securing 202 a container support to a frame. The container support includes a base assembly having a first side and a second side, a connector attached to the first side of the base assembly, a handle assembly having a first side and a second side, a plurality of arms attached to the second side of the base assembly and to the first side of the handle assembly, and a closer. The connector is attached to the frame. The method also includes adjusting 204 the arms, the base assembly, and the handle assembly from a closed configuration to an open configuration. The method further includes securing 206 a container within the container support. The method also includes adjusting 208 the arms, the base assembly, and the handle assembly from the open configuration to the closed configuration. The container is sealed and closed such that vapors generated by collected waste are contained within the container when the arms, the base assembly, and the handle assembly are in the closed configuration.

Figure 13:
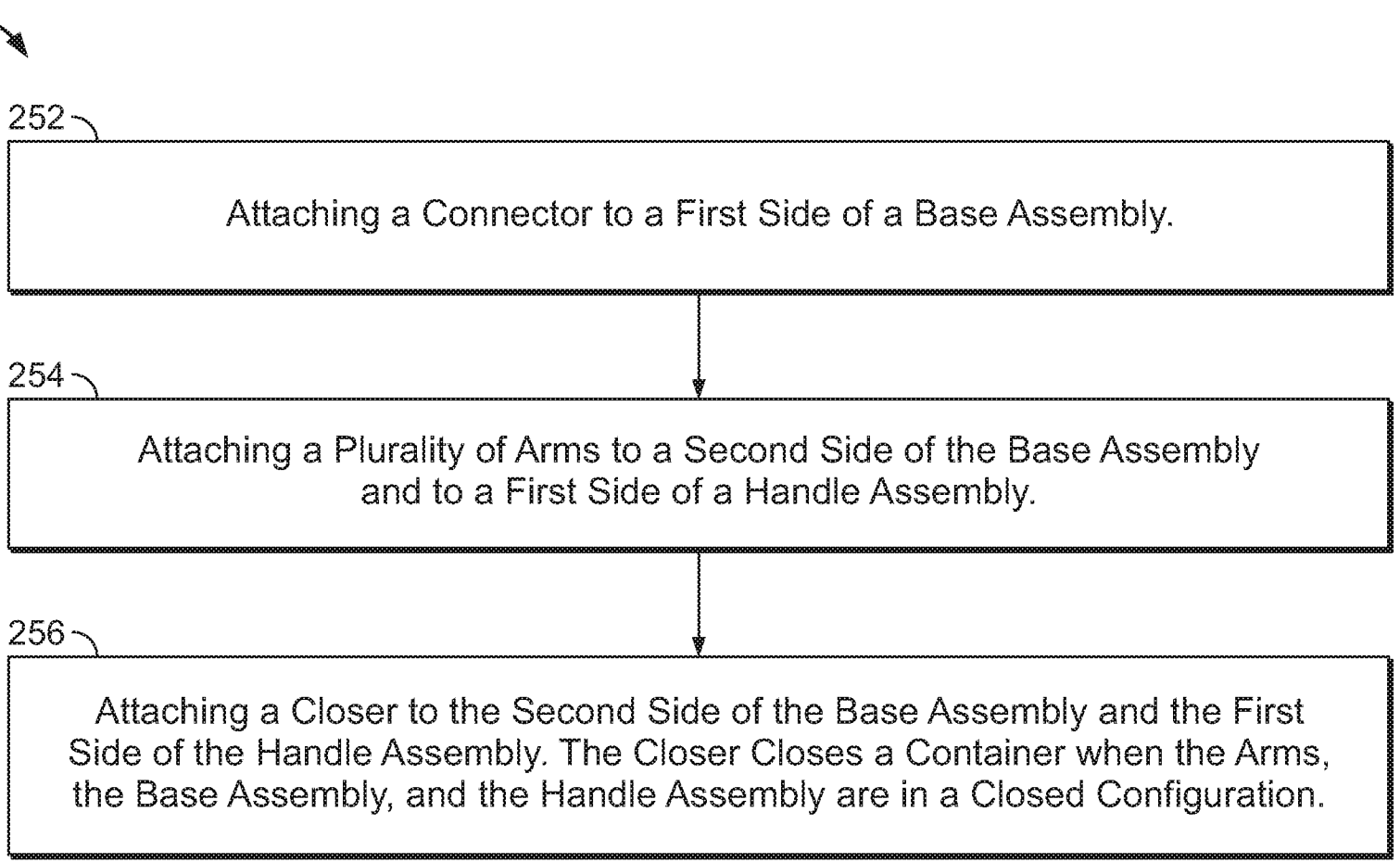
FIG. 13 is a flow diagram of an example of a method of manufacturing a container support.

FIG. 13 is a flow diagram of an example of a method 250 of manufacturing a container support. The method includes attaching 252 a connector to a first side of a base assembly. The method also includes attaching 254 a plurality of arms to a second side of the base assembly and to a first side of a handle assembly. The method further includes attaching 256 a closer to the second side of the base assembly and the first side of the handle assembly. The closer closes a container when the arms, the base assembly, and the handle assembly are in a closed configuration.

The above described examples of the systems and methods described herein include a container support for holding and sealing a container configured to collect waste at a construction project. The waste generated by the construction project may generate vapor that need to be contained. In order to contain the waste and the vapors generated by the waste, the container support holds the container such that the container support and the container are reconfigurable between an open configuration and a closed configuration. The waste is loaded into the container when the container support and the container are configured in the open configuration, and the vapors are contained in the container when the container support and the container are configured in the closed configuration. Additionally, the container support includes a closer, a handle assembly, and a plurality of arms configured to allow an operator to quickly and easily reconfigured the container support and the container between the open and closed configurations. More specifically, the closer maintains the container support and the container in the closed configuration until the operator engages the handle assembly. The arms, the handle assembly, the closer, and the container are then reconfigured in the open configuration, and the operator places the waste in the container. The operator then reengages the handle assembly such that the arms, the handle assembly, the closer, and the container are reconfigured in the closed configuration, and the vapors generated by the waste are contained in the container. Accordingly, the container support and the container are easily reconfigurable between the open configuration and the closed configuration to contain vapors generated by the waste within the container.

The systems and methods described herein are not limited to the specific examples described herein, but rather, components of the systems and/or steps of the methods may be utilized independently and separately from other components and/or steps described herein.

Although specific features of various examples of the disclosure may be shown in some drawings and not in others, this is for convenience only. In accordance with the principles of the disclosure, any feature of a drawing may be referenced and/or claimed in combination with any feature of any other drawing.

As used herein, an element or step recited in the singular and proceeded with the word "a" or "an" should be understood as not excluding plural elements or steps unless such exclusion is explicitly recited. Furthermore, references to "one example" of the present disclosure or "an example" are not intended to be interpreted as excluding the existence of additional examples that also incorporate the recited features.

This written description uses examples to disclose various examples, which include the best mode, to enable any person skilled in the art to practice those examples, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A container support for holding and closing a container, the container support comprising:

a base assembly having a first side and a second side;

a connector for connecting the container support to a frame, the connector attached to the first side of the base assembly;

a handle assembly having a first side and a second side;

a plurality of arms directly connected to the second side of the base assembly and to the first side of the handle assembly, wherein the plurality of arms, the base assembly, and the handle assembly are movable between a closed configuration and an open configuration, wherein the container is unsealed and open when the plurality of arms, the base assembly, and the handle assembly are in the open configuration, and wherein the container is sealed and closed when the plurality of arms, the base assembly, and the handle assembly are in the closed configuration; and one or more hinges defined on at least one of the base assembly or the handle assembly, the one or more hinges connecting the arms to at least one of the base assembly or the handle assembly for opening and closing the container support.

2. The container support of claim 1 further comprising a closer for closing the container when the arms, the base assembly, and the handle assembly are in the closed configuration.

3. The container support of claim 2, wherein the closer includes a plurality of magnets for sealing the container.

4. The container support of claim 3, wherein the plurality of magnets includes a first magnet attached to the second side of the base assembly and a second magnet attached to the first side of the handle assembly.

5. The container support of claim 3, wherein the plurality of magnets includes a first magnet attached to a first arm, of the plurality of arms, and a second magnet attached to a second arm, of the plurality of arms, positioned opposite the first arm.

6. The container support of claim 2, wherein the closer includes a push-to-open hinge.

7. The container support of claim 1, wherein the connector includes a mount for securing the container support to the frame, the mount including at least one of a clamp, a hook, and an adhesive.

8. The container support of claim 1 further comprising at least one detent configured to maintain the container support in either the open configuration or the closed configuration.

9. The container support of claim 1, wherein the plurality of arms includes a first arm, a second arm, a third arm, and a fourth arm, wherein the first arm and the second arm are connected to the second side of the base assembly via the one or more hinges defined on the base assembly, wherein the third arm and the fourth arm are connected to the first side of the handle assembly via the one or more hinges defined on the handle assembly, wherein the container support comprises one or more additional hinges, wherein the first arm is connected to the third arm via the one or more additional hinges, and wherein and the second arm is hinged to the fourth arm via the one or more additional hinges.

10. The container support of claim 1, wherein the handle assembly includes a handle attached to the second side of the handle assembly.

11. A method of containing vapors generated by collected waste, the method comprising:

providing the container support of claims 1;

securing the container support to the frame, the container support including a closer, wherein the connector is attached to the frame;

adjusting the plurality of arms, the base assembly, and the handle assembly from the closed configuration to the open configuration;

securing the container within the container support; and adjusting the arms, the base assembly, and the handle assembly from the open configuration to the closed configuration, wherein the container is sealed and closed such that vapors generated by a collected waste is contained within the container when the arms, the base assembly, and the handle assembly are in the closed configuration.

12. The method of claim 11, wherein securing the container support to the frame comprises mounting the container support to the frame.

13. The method of claim 11, wherein the container includes a bag, and wherein securing the container within the container support comprises inserting the bag into the container support and folding a top of the bag over the arms.

14. The method of claim 13, wherein adjusting the plurality of arms, the base assembly, and the handle assembly from the closed configuration to the open configuration comprises moving the handle assembly away from the base assembly such that the closer disengages and the arms rotate into an opening configured to receive the collected waste, wherein the handle assembly is configured to be moved by a user by grabbing the handle assembly.

15. The method of claim 13, wherein adjusting the arms, the base assembly, and the handle assembly from the open configuration to the closed configuration comprises moving the handle assembly toward the base assembly such that the closer engages and the arms rotate into the closed configuration configured to contain vapor generated by the collected waste within the container, wherein the handle assembly is configured to be moved by a user by grabbing the handle assembly.

16. The method of claim 13, wherein the closer includes a push-to-open hinge, and wherein adjusting the arms, the base assembly, and the handle assembly from the closed configuration to the open configuration comprises pushing the handle assembly toward the base assembly such that the push-to-open hinge disengages and the arms rotate into an opening configured to receive the collected waste, wherein the handle assembly is configured to be pushed by a user by grabbing the handle assembly through the bag.

17. A method of manufacturing a container support, the method comprising:

providing the container support of claim 1;

attaching the connector to the first side of the base assembly;

hingedly attaching the plurality of arms to the second side of the base assembly and to the first side of the handle assembly; and attaching a closer to the second side of the base assembly and the first side of the handle assembly, wherein the closer closes the container when the arms, the base assembly, and the handle assembly are in a closed configuration.

18. The method of claim 17, wherein the closer seals the container.

19. The method of claim 17 further comprising forming a plurality of receptacles in the second side of the base assembly and the first side of the handle assembly, wherein the closer includes a plurality of magnets positioned within the receptacles.

20. The method of claim 19 further comprising adjusting the closer formed by the closer by adding or removing the magnets from the receptacles.

* * * * *